United States Patent [19]

Irwin et al.

[11] 4,121,218

[45] Oct. 17, 1978

[54] ADJUSTABLE ANTENNA ARRANGEMENT FOR A PORTABLE RADIO

[75] Inventors: James Stuart Irwin, Ft. Lauderdale; Francis Robert Steel, Parkland, both of Fla.

[73] Assignee: Motorola, Inc., Schaumburg, Ill.

[21] Appl. No.: 821,453

[22] Filed: Aug. 3, 1977

[51] Int. Cl.[2] ..... H01Q 1/24; H01Q 9/00; H01Q 1/36

[52] U.S. Cl. ..... 343/702; 343/750; 343/895

[58] Field of Search ..... 343/702, 749, 750, 788, 343/895

[56] References Cited

U.S. PATENT DOCUMENTS

| | | | |
|---|---|---|---|
| 2,419,611 | 4/1947 | Walsh | 343/749 |
| 2,948,894 | 8/1960 | Carpenter, Jr. | 343/895 |
| 3,104,394 | 9/1963 | Yokoyama | 343/750 |
| 3,543,275 | 11/1970 | Wendell | 343/750 |

*Primary Examiner*—Alfred E. Smith
*Assistant Examiner*—Harry E. Barlow
*Attorney, Agent, or Firm*—Margaret Marsh Parker; James W. Gillman

[57] ABSTRACT

An extendable half-wave dipole is capacitively coupled to a driven resonant helical antenna for use as on a hand-held, two-way portable radio, the helix being end fed. The dipole may be mounted adjacent to or collinear with the axis of the helix. The collinear mounting requires non-conductive portions on each end of the dipole. Optimum dimensional and performance characteristics are available without switching.

9 Claims, 8 Drawing Figures

ADJUSTABLE ANTENNA ARRANGEMENT FOR A PORTABLE RADIO

BACKGROUND OF THE INVENTION

This invention relates to the field of antennas and more particularly to antennas for hand-held radios.

Two-way, hand-held radios have, almost exclusively, used monopole antennas utilizing the radio housing as one element or ground plane. Such antennas have been, typically, a quarter-wave whip or a physically shorter, quarter-wave helix. Since the small hand-held case is inadequate as an antenna element, the efficiency of the whip is less than that of a half-wave dipole. Helical antennas are sometimes potted in a suitable dielectric material or covered with a flexible insulative coating and have been favored for their ruggedness combined with the short lengths. However, they are inherently less efficient and, because of their short length, are strongly effected by the user's body and head, producing undesirable directivity effects. Helical antennas are difficult to tune properly and typically, after fabrication, are measured and trimmed repeatedly for the final adjustment.

Many antenna structures have been designed utilizing both rod and helix antennas. These have varied according to the application, size limitation, tuning requirements and the like. None have, however, provided a satisfactory antenna for use on a portable radio without complex structures and/or switching. Portable radios as used in security applications are typically carried on the operator's person, clipped directly to a belt or in a carrying case for belt, shoulder strap or chest carry. A long whip antenna, while desirable in certain circumstances, could be inconvenient and possibly dangerous under some emergency circumstances. A whip antenna alone could not be retracted as necessary since the radio must be operative at all times and the performance of a whip is severely degraded when greatly shortened. The ideal antenna would have a very short, but satisfactory, antenna to be used under normal conditions, but having available a reliable half-wave element for use under difficult transmitting conditions.

SUMMARY OF THE INVENTION

It is, therefore, an object of the present invention to provide a near-ideal antenna for hand-held radios.

It is a particular object to provide such an antenna combining the characteristics of minimum length and ruggedness in normal use with longer lengths and maximum efficiency when necessary.

It is a more particular object to provide the desired characteristics with a simple and reliable structure.

These objects and others are provided in an antenna arrangement in accordance with the invention and including a short, driven, resonant helix combined with an adjacent or collinear extendible parasitic, half-wave whip. Matching is accomplished by the length of the parasitic element and the spacing between the elements. Since the whip antenna is only capacitively coupled, no switching is required, and no rematching is required since the impedances are sufficiently alike in the two modes of operation.

DETAILED DESCRIPTION OF A PREFERRED EMBODIMENT

Figure 1A:
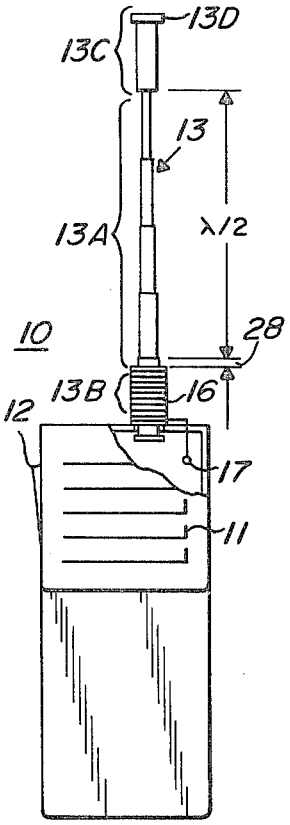
FIGS. 1A and 1B are partially cut-away elevational views of a small two-way radio including a preferred embodiment of the invention in its two operating modes.

The invention will be best understood in relation to the accompanying drawing in which like parts bear like reference numerals throughout.

Figure 1B:
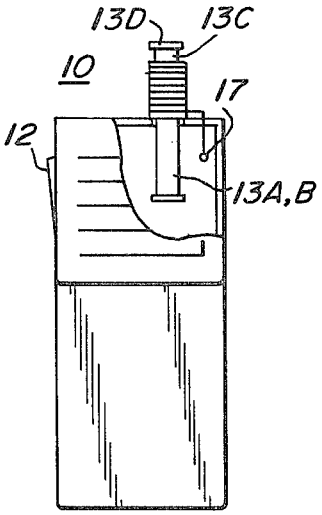

FIGS. 1A and 1B show a partially cut-away view of a typical small hand-held, two-way radio, referenced generally as 10. The radio 10 is of the type used in security operation and is often carried on the user's person. Speaker and microphone may be mounted behind a grille 11 which is formed integrally with the radio housing. A push-to-talk (PTT) button 12 is usually positioned for being operated conveniently by the thumb of the user when the radio is held in the normal position for use.

In FIG. 1A, a monopole 13 is shown fully extended, i.e., at maximum length with a conductive portion 13A pulled through and beyond a resonant helical element 16. The helix 16 is connected to an input/output terminal 17 of the radio 10 circuitry (not shown) and may be rubber covered for protection and maximum flexibility.

On the lower end of the conductive portion 13A is a non-conductive portion 13B having a diameter less than the inside diameter of the helix 16 and long enough to position the bottom end of the extended conductive portion 13A the proper distance above the top of the helix 16 as will be discussed hereinafter. A second non-conductive portion 13C is attached to the top end of the conductive portion 13A, and also has a diameter smaller than the inside diameter of the helix 16. The function of the portion 13C is to allow the conductive portion 13A to be telescoped into a location completely below the helix 16, yet provide means for withdrawing the portion 13A. In other words, when the portion 13A is completely telescoped and contained within the radio housing below the helix 16, the upper portion 13C should protrude far enough above the helix to enable the user to grasp and extend the antenna 13. The conductive portion 13A can be made to extend partially into the non-conductive portion 13C for final adjustment of the helical element 16. This procedure is a much simpler factory adjustment than any known in the prior art. The antenna 13 may also include a flange portion 13D for easier extension.

In FIG. 1B, the antenna arrangement of FIG. 1A is shown with the monopole 13 completely retracted or telescoped. The conductive portion 13A and the non-conductive portion 13B are completely within the radio housing and portion 13A is no longer part of the functioning antenna arrangement.

Figure 2A:
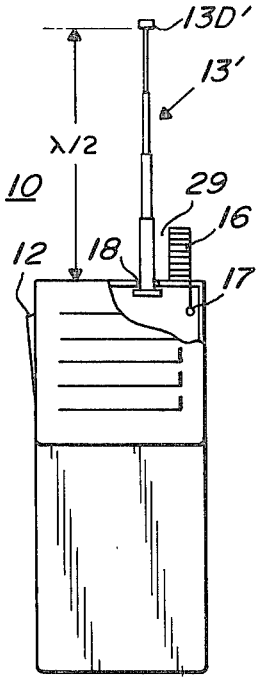
FIGS. 2A and 2B show similar views of another embodiment of the invention.
Figure 2B:
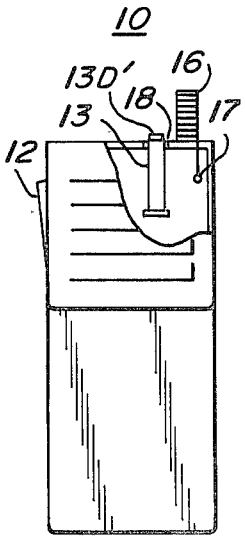

In FIG. 2A, the helix 16 may be as in FIGS. 1A and 1B or may be solidly potted as desired. Mounted adjacent the helix 16 is a telescoping half-wave whip antenna 13'. The entire length of antenna 13' is conductive, but a pull-out button or flange 13D' may be of an insulating material such as hard plastic. In FIG. 2B, the antenna 13′ is shown completely telescoped within the radio 10 housing. In this position, the pull-out button 13′ may serve as a weather cover for the antenna aperture 18 in the housing of the radio 10.

Figure 3:
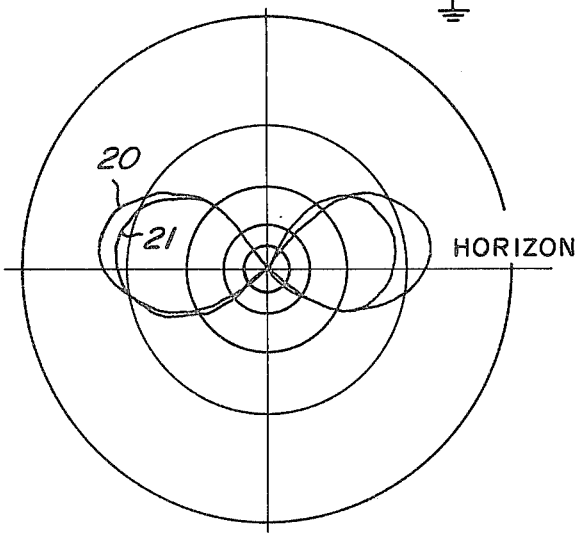
FIG. 3 shows the vertical patterns of the two embodiments in the extended modes of FIGS. 1A and 2A.

FIG. 3 shows vertical radiation patterns 20 and 21 for the embodiments of FIGS. 1A and 2A respectively. Both patterns 20 and 21 show the desired vertical polarization, i.e., with maximum sensitivity no more than 30° above the horizon.

Figure 4:
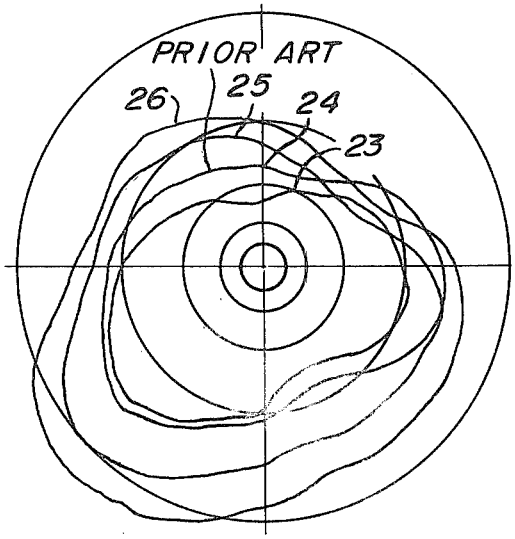
FIG. 4 shows the horizontal pattern for the antennas of FIGS. 1A and 1B, 2A and 2B as well as a prior art antenna.

FIG. 4 shows the horizontal patterns of four antennas used with the same portable radio. In each case, the radio was held in the user's left hand and adjacent the user's mouth. Pattern 23 is that of a helical antenna, essentially the antenna 16, used alone, as in FIGS. 1B and 2B. Pattern 24 is that of a 6 inch quarter-wave whip as has been used in the past for such applications. Pattern 24 is included for comparison purposes only. Pattern 25 is that of the antenna arrangement shown in FIG. 2A and the pattern 26 is for the arrangement shown in FIG. 1A.

The pattern 23 is the poorest in regard to all-around performance and, in particular, shows the most effect from the user's person as would be expected from its size. Antenna 16, while electrically a quarter-wave length antenna, is physically much shorter, thus is more overshadowed by the head and shoulders of the user than is the quarter-wave whip. The short physical length of the helix is, however, an overriding advantage for the user under normal conditions, thus it has been widely used.

Both of the patterns 25 and 26 show substantial improvements over the patterns 23 and 24. The patterns 25 and 26 are very similar, with pattern 26 being somewhat the better as would be expected, since the antenna 13 is slightly higher when fully extended than is the antenna 13′.

Returning now to FIGS. 1A and 2A, the parasitic elements 13 and 13′ are matched by their respective lengths and their spacings from the helical driven element 16. Representative dimensions for the 450 MHz band might be 12 inches (30.5 centimeters) for antenna 13A with a spacing 28 of 0.15 inches (0.4 centimeters) between the antenna portion 13A and the top of the helix 16. The antenna 13′ might be 11 inches (28 centimeters) in length, with a spacing 30 of 0.5 inches (1.25 centimeters) between the antenna 13′ and the nearest part of the helix 16. The helix 16 might be 1.5 inches (3.8 centimeters) in physical length with a diameter of 0.25 inches (0.64 centimeters). The antenna arrangement shown and described is applicable in principle for use over a range of frequencies including at least 150 MHz to 900 MHz.

Figure 5A:
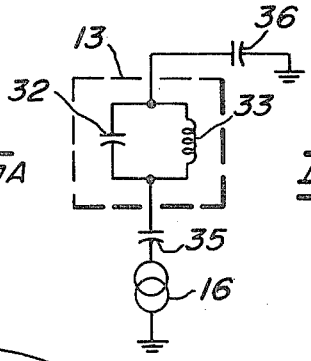
FIGS. 5A and 5B are equivalent circuits for the embodiments of FIGS. 1A and 2A respectively.

FIG. 5A is a simplified equivalent circuit of the antenna arrangement of FIG. 1A. The antenna 13 (in dashed line) is represented by a parallel-tuned circuit including capacitor 32 and inductance 33. The coupling capacitance between the antenna 13 and the helix 16 is a capacitor 35. The end capacitance of the antenna 13 is the capacitor 36.

Figure 5B:
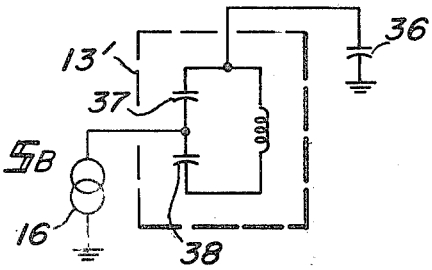

In FIG. 5B is shown a simplified equivalent circuit for the embodiment of FIG. 2A. Here the end capacitance is the capacitor 36 and the distributed capacitance of the antenna 13 and the coupling capacitance of the antenna 13 to the helix 16 are combined as are capacitors 37 and 38.

The difference in impedance between the combined arrangements and the helix alone is small enough that no rematching is required. Since the extendable antennas are coupled by capacity only, no switching of any kind is required. Thus, there has been shown an antenna arrangement for portable radio which is convertible from a very short, but normally satisfactory antenna, to a longer and much more efficient antenna as needed. Since no switching or rematching is required, the arrangement is both economical and reliable.

What is claimed is:

1. An antenna arrangement as for a hand-held transceiver and comprising in combination:
   - a helical antenna means mounted on the transceiver and coupled to be driven by the circuitry of the transceiver; and
   - an extendable half-wave antenna means, mounted on the transceiver and adapted to be capacitively coupled to said helical antenna means when in the extended position and to be substantially decoupled therefrom when in the retracted position.

2. An antenna arrangement according to claim 1 and wherein the spacing between said helical antenna means and said extendable antenna means provides a predetermined amount of capacitance for coupling signals from said helical antenna means to the extendable antenna means.

3. An antenna arrangement according to claim 1 and wherein said helical antenna means has an electrical length of substantially one-quarter wave length for the desired band of frequencies, and a physical length substantially less than said one-quarter wave length.

4. An antenna arrangement according to claim 1 and wherein a predetermined portion of the extendable antenna means may remain within the helical antenna means when said extendable antenna means is in the retracted position for fine tuning of said helical antenna means.

5. An antenna arrangement according to claim 1 and wherein said extendable antenna means is mounted adjacent said helical antenna means and is adapted to be retracted completely within the body of the transceiver.

6. An antenna arrangement according to claim 5, said extendable antenna means including means for withdrawing said antenna means from the transceiver body.

7. An antenna arrangement according to claim 1 and wherein said extendable antenna means is mounted coaxially with said helical antenna means and is smaller in diameter than the inside diameter of said helical antenna means.

8. An antenna arrangement according to claim 7 and wherein said extendable antenna means includes a central conductive portion, a first non-conductive portion attached to the upper end of said conductive portion and a second non-conductive portion attached to the lower end of said conductive portion.

9. An antenna arrangement according to claim 8 and wherein said central conductive portion is adapted to be retracted completely within the body of the transceiver.

* * * * *